US009708844B2

(12) United States Patent
Glogowski et al.

(10) Patent No.: US 9,708,844 B2
(45) Date of Patent: Jul. 18, 2017

(54) SLIDING DOOR CLOSING DEVICE

(71) Applicant: Komandor S.A., Radom (PL)

(72) Inventors: Mariusz Glogowski, Nidzica (PL); Piotr Szymanski, Kowala-Stepocina (PL)

(73) Assignee: Komandor S.A., Radom (PL)

( * ) Notice: Subject to any disclaimer, the term of this patent is extended or adjusted under 35 U.S.C. 154(b) by 0 days.

(21) Appl. No.: 15/112,853

(22) PCT Filed: Jan. 29, 2015

(86) PCT No.: PCT/PL2015/000008

§ 371 (c)(1),
(2) Date: Jul. 20, 2016

(87) PCT Pub. No.: WO2015/115921

PCT Pub. Date: Aug. 6, 2015

(65) Prior Publication Data

US 2016/0333622 A1 Nov. 17, 2016

(30) Foreign Application Priority Data

Jan. 30, 2014 (PL) ..... 407002

(51) Int. Cl.
*E05F 3/00* (2006.01)
*E05F 3/18* (2006.01)
(Continued)

(52) U.S. Cl.
CPC ..... *E05F 3/18* (2013.01); *E05F 1/16* (2013.01); *E05F 3/224* (2013.01); *E05F 5/003* (2013.01);
(Continued)

(58) Field of Classification Search
CPC ..... E05F 5/003; E05F 5/05; E05F 1/08; E05F 1/1091; E05F 1/16; E05F 3/00;
(Continued)

(56) References Cited

U.S. PATENT DOCUMENTS

2010/0071154 A1* 3/2010 Bortoluzzi ..... E05F 1/16 16/85
2011/0023370 A1* 2/2011 Zimmer ..... E05F 1/16 49/360
(Continued)

FOREIGN PATENT DOCUMENTS

DE 202011102428 U1 10/2011
DE 102010061161 A1 6/2012
(Continued)

OTHER PUBLICATIONS

International Search Report dated Apr. 23, 2015, International Application No. PCT/PL2015/000008.

*Primary Examiner* — Chuck Mah
(74) *Attorney, Agent, or Firm* — Young Basile Hanlon & MacFarlane, P.C.

(57) ABSTRACT

A sliding door closing device having an easy door opening function with an opening system. The closing device provides a slider with an attachment and gripper on one side of the device, and a properly shaped support of a moving roller on the other side of the device. A pusher contacts a roller support of the roller with a slider gripper and an opening spring and choke. The opening system allows for the opening of a door by pushing the door on vertical strip or on the edge.

2 Claims, 4 Drawing Sheets

(51) Int. Cl.

| | |
|---|---|
| ***E05F 5/00*** | (2017.01) |
| ***E05F 1/16*** | (2006.01) |
| ***E05F 3/22*** | (2006.01) |
| ***E05F 5/02*** | (2006.01) |

(52) U.S. Cl.
CPC ..... *E05F 5/02* (2013.01); *E05Y 2201/232* (2013.01); *E05Y 2201/426* (2013.01); *E05Y 2201/638* (2013.01); *E05Y 2201/688* (2013.01); *E05Y 2800/11* (2013.01)

(58) Field of Classification Search
CPC ..... E05F 3/02; E05F 3/04; E05F 3/18; E05F 3/227; E05F 3/22; E05F 3/10; E05F 3/108; E05F 3/224; E05F 5/02; E05Y 2800/24; E05Y 2800/21; E05Y 2201/64; E05Y 2201/644; E05Y 2201/264; E05Y 2201/41; E05Y 2201/412; E05Y 2201/47; E05Y 2201/21; E05Y 2201/488; E05Y 2900/132; E05Y 2900/142; E05Y 2900/14; E05Y 2201/232; E05Y 2201/426; E05Y 2201/638; E05Y 2201/688; E05Y 2800/11; Y10T 16/27; Y10T 16/56; Y10T 16/61; Y10T 16/593; Y10T 16/276; Y10T 16/281; Y10T 16/379; E05D 15/00; E05D 15/06; E05D 15/12; A47B 88/047; A47B 88/12; A47B 88/14; A47B 2210/0091
See application file for complete search history.

(56) References Cited

U.S. PATENT DOCUMENTS

| | | | | |
|---|---|---|---|---|
| 2011/0167588 | A1* | 7/2011 | Chang | E05F 5/003 16/71 |
| 2013/0014343 | A1* | 1/2013 | Tanno | E05F 1/16 16/49 |
| 2013/0091665 | A1* | 4/2013 | Tsai | E05F 3/18 16/49 |
| 2013/0167444 | A1 | 7/2013 | Ryden et al. | |
| 2013/0182978 | A1* | 7/2013 | Huang | A47B 88/467 384/21 |
| 2013/0203075 | A1* | 8/2013 | Svenson | G01N 33/564 435/7.5 |
| 2013/0219657 | A1* | 8/2013 | Iwaki | E05F 1/16 16/64 |
| 2014/0026357 | A1* | 1/2014 | Zimmer | E05F 1/16 16/72 |
| 2014/0109343 | A1* | 4/2014 | Chang | E05F 5/003 16/49 |

FOREIGN PATENT DOCUMENTS

| | | | | |
|---|---|---|---|---|
| DE | 102011010778 | A1 | 8/2012 | |
| ES | EP 2546444 | A2 * | 1/2013 | E05F 5/003 |
| JP | WO 2006011294 | A1 * | 2/2006 | E05F 1/16 |
| JP | 2006063767 | A * | 3/2006 | |
| JP | 2008223456 | A * | 9/2008 | |
| KR | 101180141 | B1 * | 9/2012 | |

* cited by examiner

SLIDING DOOR CLOSING DEVICE

CROSS REFERENCE TO RELATED APPLICATION

The entire content of Polish Patent Application No. P.407002, filed on Jan. 30, 2014 in which the priority right of the present patent application is claimed is herein incorporated by reference.

TECHNICAL FIELD

The subject of the invention is a device for closing sliding doors, designed for use in the furniture industry, built-ins and interior arrangement.

BACKGROUND

Sliding door closing devices prevent the door from closing too fast and hitting against an external frame, side wall or frame. They prevent the hand from being crushed or damage to the door structure.

From patent description US2013167444A1, a sliding door arrangement is known, in which the force of a rapidly closing door is dampened by a gas shock absorber mounted in a guide rail. A pin is attached to the door, which, while closing, engages with a gripper attached at the end of the shock absorber.

From Polish utility model application W.120907, a sliding door closing device is known, which comprises three systems for shock absorbing and gripping, spring tension adjustment and an adjustable device mounting inside the guide rail. While sliding (opening) the door, the shock absorbing and gripping system is tensioned by the spring tension adjustment system, and an engagement pin is released from a driver, and the door continues sliding freely. While closing, the rapidly closing door with the engagement pin hits its driver, the shock absorbing and gripping system is released, the door is braked and energy is dissipated, and the door continues closing slowly, controlled by the spring tension adjustment system, until it closes completely.

Solutions known from the above descriptions are able to brake rapidly closing doors, yet they are difficult to open since, until the shock absorber is released, the resistance of the shock absorbing system has to be overcome. This is particularly difficult for doors without handles or strips intended for opening.

The purpose of the invention is to develop a sliding door closing device that will brake a rapidly sliding door leaf and close it to make contact with a side edge, but would allow easy and effortless opening at the same time.

The door closing device, according to the invention, has a body. The body, in its upper part, has longitudinal holes in the side walls, located in the vicinity of the body ends. In the lower part of the body, there is a longitudinal component located in parallel to the base, which serves as a pusher, and—in the upper part of the body—above the pusher, there is a slider with lateral holes at the ends.

Inside the slider, there are two chambers. In one of them, there is a spring and a choke of the closing device, and in the other chamber, the gripper of the closing device is fixed slidably, connected with the closing device choke and which remains in contact with the closing device spring. The end part of the slider, at the side of the spring and choke, is terminated with a hooked attachment. To one of the external walls of the body, the spring and—on the opposite side—the choke of the opening device is mounted. The ends of the spring and choke of the opening device are permanently attached to the body wall and—on the other side—connected with a lateral joiner placed through holes in the body and in the slider. On one of the ends, the body is fitted with the rotary and spring mounted slider gripper, which remains in contact with the pusher, and is provided with an attachment that fits to the one at the end of the slider. On the opposite side of the body, there is a permanently fixed housing in which there are two rollers arranged in parallel to the body base, whereby one roller is movable and one is stationary. The movable roller is fitted in a support that is spring-mounted to the housing, and its side surface remains in contact with the pusher end.

Preferably, the closing device body has the shape of a channel bar, which, in the cross section, is narrower in the lower part than in the upper part.

The sliding door closing device, according to the invention, features an easy door opening function with an opening system comprising a slider with an attachment and gripper on one side, properly shaped support of the moving roller on the other side, and a pusher contacting the roller support with a slider gripper, the opening device spring, and the choke. The opening system allows for opening of the door by pushing the door on a vertical strip or on the edge. Pushing on the door moves the support on the moving roller and simultaneously moves the pusher on the support wedge and releases the pusher from the gripper. In one variant of the door closing device, according to the invention, the pusher releases the slider from the gripper by a pushing movement, and in the other variant, it does so by a pulling movement. By opening the opened door, tension is placed on the closing device spring with the gripper of the closing device moving inside the slider. The stroke of the slider is determined by the length of longitudinal holes in the body. Preferably, the length of the holes is approx. 25 mm. When tension is placed on the spring, the gripper is locked, and the door moves freely on the guide rails. While closing, the closing device gripper is released by the door guide gripper, and the door is closed by placing tension on the opening spring and moving the slider in the body and locking it with the slider gripper at the same time. The closing spring pulls the door to the inner side of the cabinet.

The closing device, according to the invention, is provided with components with the additional function of releasing the door closing system, thanks to which, at first, the door is much easier to open, and activating the opening mechanisms requires only a slight push on the door or on a vertical profile in which the door is fixed.

BRIEF DESCRIPTION OF THE DRAWINGS

The sliding door closing device, according to the invention, is presented in a sample embodiment in a drawing, in which.

DETAILED DESCRIPTION OF THE EMBODIMENTS

Figure 1:
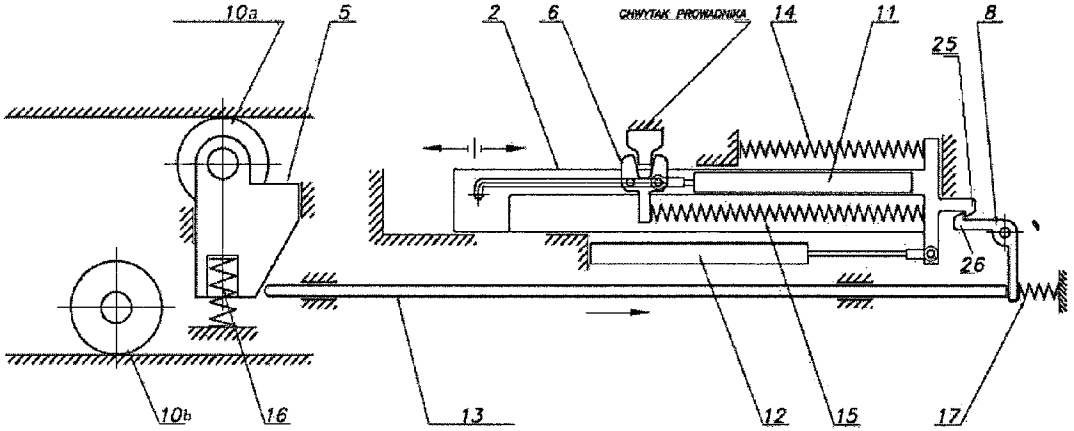
FIG. 1 presents a simplified diagram of the first variant of the device with the door closed.

A sample embodiment of the first variant of the sliding door closing device according to the invention is presented in the drawing, which has a metallic body 1 in the shape of a channel bar, which, in the cross section, is narrower in the lower part than in the upper part. At the ends of the body 1, there is a starting attachment 7 and an end attachment 9. The starting and end attachments are profiled so as to fit to the inner side of the horizontal door profile. The body 1 has four 25 mm long holes 23*a* and 23*b* in the side walls of the upper part. In the lower part of the body 1, there is a longitudinal component 13, which serves as a pusher, and—in the upper, wider part of the body—above the pusher 13, there is a slider 2 with holes 24*a* and 24*b* at the ends. The slider 2 can travel in the body at the distance of 25 mm, since it is held with pins 19 and 21 placed in the holes 24*a* and 24*b*, moving in the holes 23*a* and 23*b* of the body 1. Inside the slider 2, there are two chambers. In one of them, there is a spring 15 and a choke 11 of the closing device, and in the other chamber, a gripper 6 of the closing device is fixed slidably, connected with the closing device choke 11 by a pin 22 and which remains in contact with the closing device spring 15. The end part of the slider, at the side of the spring 15 and choke 11, is terminated with a hooked attachment 25. To one of the external walls of the body 1, a spring 14 and—on the opposite side—a choke 12 of the opening device is mounted. The ends of the spring 14 and choke 12 of the opening device are permanently attached to the body 1 wall on one side and—on the other side—connected with the pin 21 placed through the holes 23*a* in the body and through the holes 24*a* in the slider. At the end part of the body 1, at the end attachment 9, there is a rotary and spring mounted slider gripper 8, which remains in contact with the pusher 13, which is provided with an attachment 26 that fits to the attachment 25 at the end of the slider. The gripper 8 is connected to the body with a pin 20, and a spring 17 holds the slider gripper in the correct position. On the opposite side of the body 1, there is a permanently fixed housing comprising of a top cover 3 and bottom cover 4. Inside the housing, there are two rollers 10*a* and 10*b* arranged in parallel to the base of the body 1, whereby the roller 10*a* is movable, and the roller 10*b* is stationary. The movable roller 10*a* is placed in a support 5 with a pin 18 on which it rotates. The support 5 of the roller 10*a* is held in position by a spring 16. The side surface of the support 5 remains in contact with the end of the pusher 13.

Figure 2:
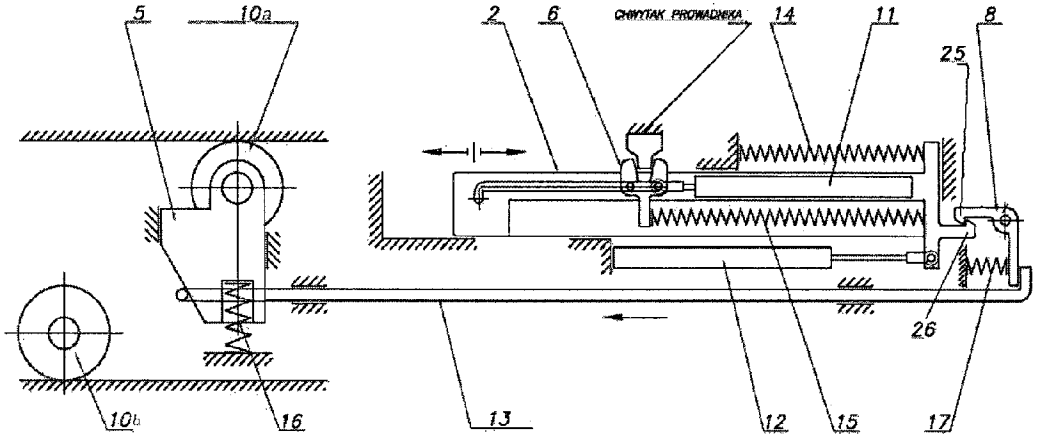
FIG. 2 presents a simplified diagram of the second variant of the device with the door closed.

In the second variant, shown in the drawing in FIG. 2, the pusher 13 remains in contact with the opposite side of the support 5, which is a mirror reflection of the support 5 of the first variant. The other end of the pusher 13 remains in contact with the slider gripper 8, which is connected to the body with the pin 20. Since, in this variant, the pusher 13 is pulled by the roller support 5, its end remains in contact with the outer side of the slider gripper 8.

Figure 3:
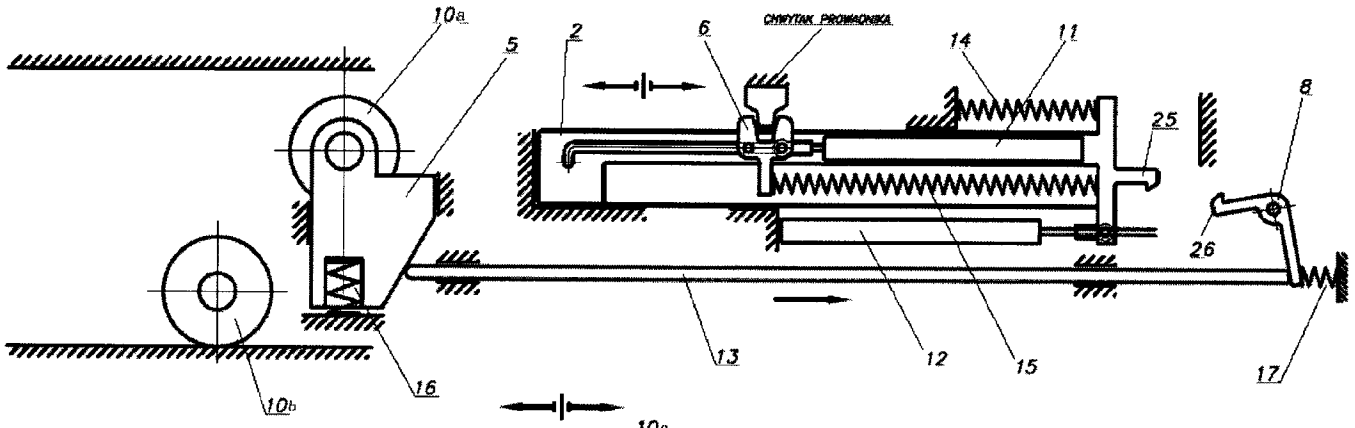
FIG. 3 presents a simplified diagram of the first variant of the device with the door opened.
Figure 4:
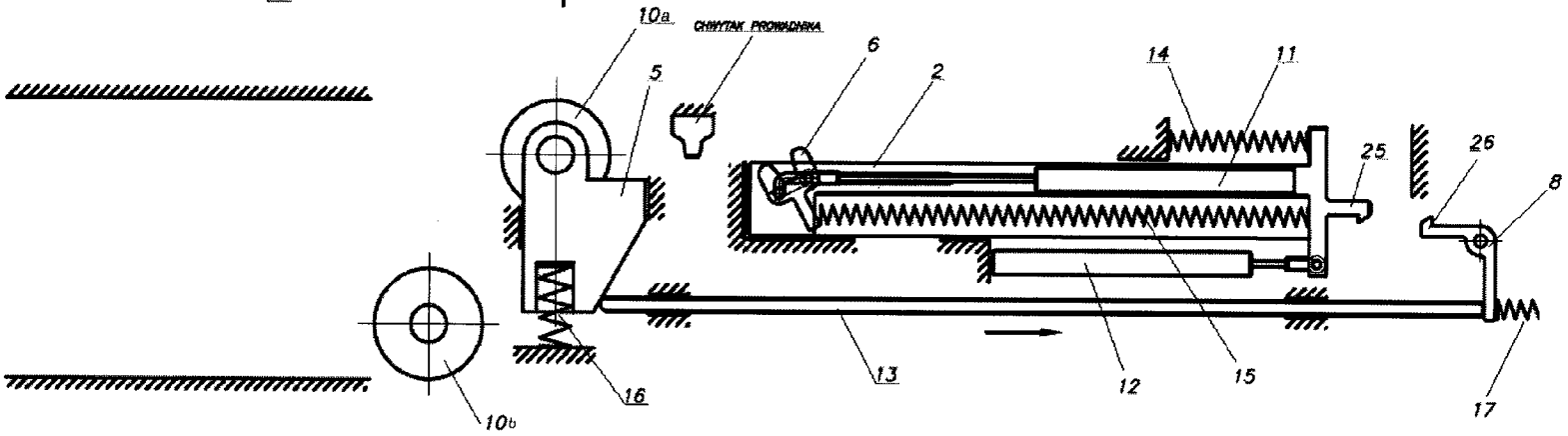
FIG. 4 presents a simplified diagram of the first variant of the device with the door slid out.
Figure 5:
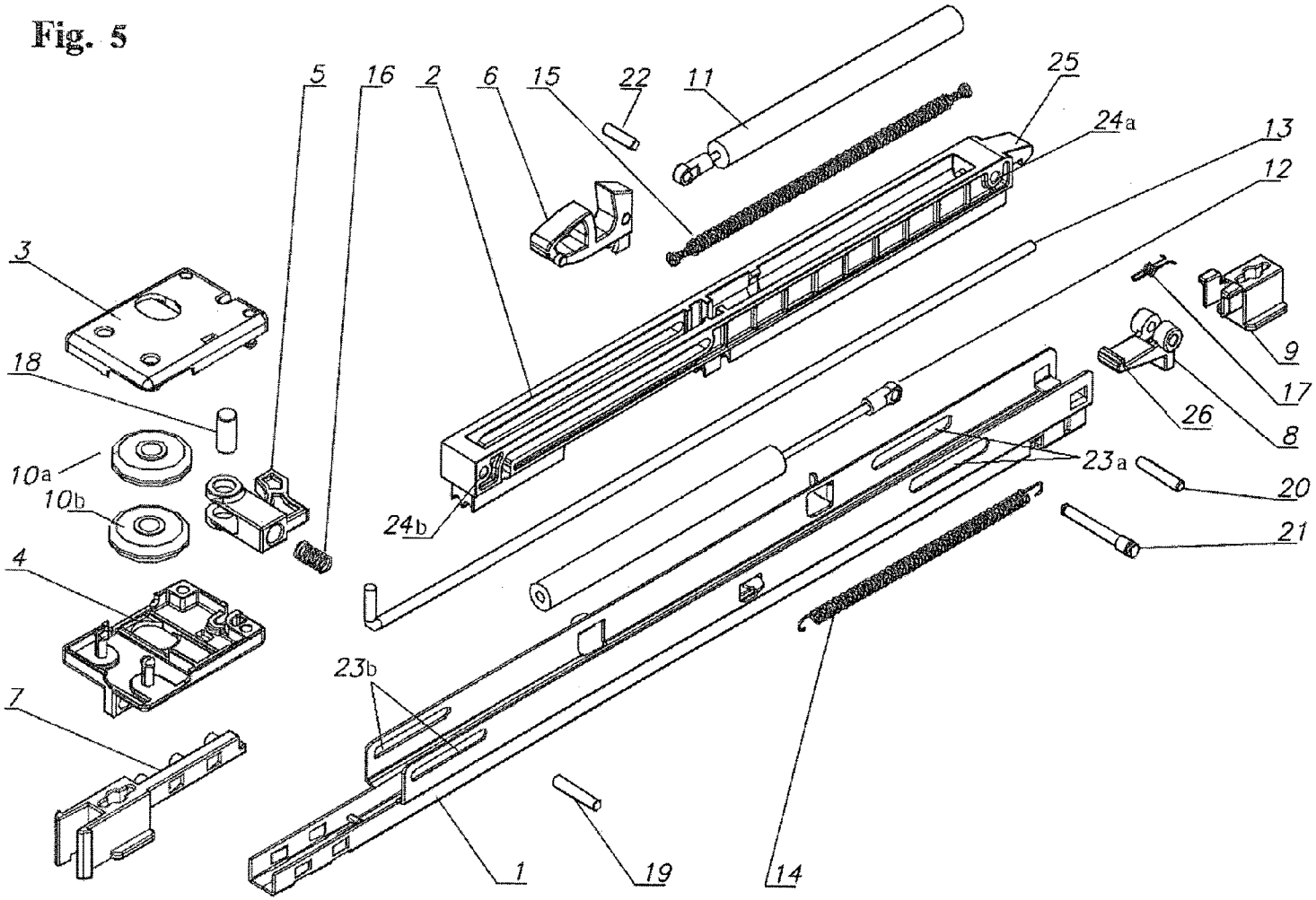
FIG. 5 presents an exploded view of the closing device components in its first variant.
Figure 6:
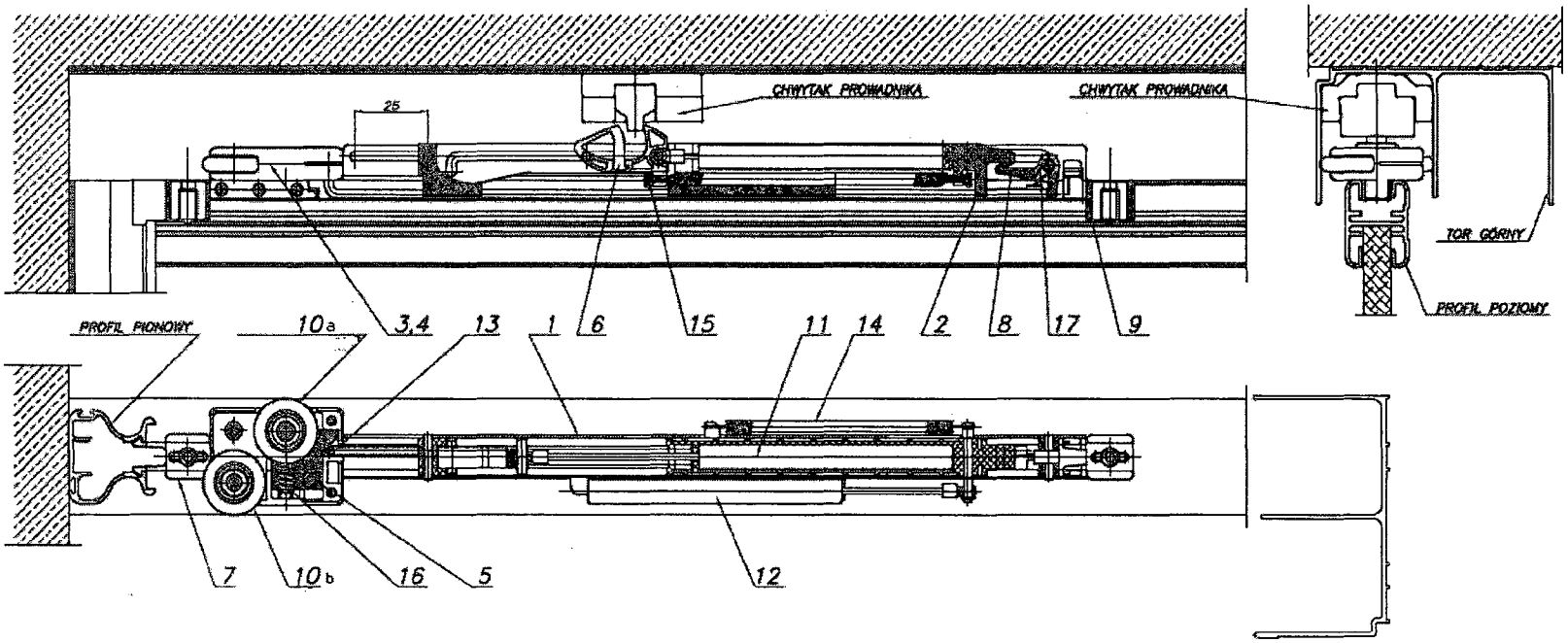
FIG. 6 presents three views of the closing device mounting in the upper track.

In the initial state, the door rests against the cabinet or wall edge, the closing device spring 15 is released, and tension is created on the opening device spring 14, i.e. it is ready to open the door. Pushing on the side edge of the door or on the profile moves the door leaf in relation to the guide rail. This causes a simultaneous movement of the roller 10*a*, moves the roller support 5 and pusher 13, whose opposite side interacts with the gripper 8. Simultaneously, the slider gripper 8 turns in an axis perpendicular to the base of the body, thus releasing the slider 2. The released slider 2 moves in the holes cut in the body over a distance of 25 mm thanks to the release of the opening device spring 14. This movement is cushioned with the opening device choke 12. Along with the slider 2 movement, the door is moved away from the framing. When continuing to open the door, the closing device slider gripper 6 is moved, allowing to reload and create tension on the closing device spring 15 at the same time. Moving along a proper trajectory within the channel in the slider 2, thanks to guides cut (guiding channels) in the slider 2, the closing device gripper 6, when it creates tension on the closing device spring 15 and the choke 11, is locked, and the door continues to open freely. While closing the door, the closing device gripper 6 is released in the slider 2 by the guide attachment 25 or 26 or end attachment 9 mounted in the door rail. The slider 2 moves back in the body 1 and creates tension on the opening device spring 14 and the choke 12. At the same time, the locked closing device gripper 6 in the slider gripper moves inside the slider 2, being pulled by the closing device spring 15. This causes a pulling of the door to the framing edge. This movement is cushioned by the closing device choke 11 connected with the closing device gripper 6. When the door is pulled, the slider 2 is locked by the slider gripper. The door is ready to open. Roller support 5 is capable of moving from the position shown in FIG. 1 to the position in FIG. 3 which activates the pusher 13 when the user lightly pushes the door in a perpendicular direction to the motion of the slider and the gripper 6.

In the second variant of the device, the movement of the roller 10*a*, while pushing, moves the support 5 which pulls the pusher 13. The pusher, being pulled and remaining in contact with the slider gripper, simultaneously causes the gripper 8 to rotate on a perpendicular axis to the body base, but in the opposite location as compared to the first variant. The slider gripper 8 has a hooked attachment on the opposite side as compared to the first variant. Its rotary movement releases the gripper.

The invention claimed is:

1. A sliding door closing device with a calming-cushioning system, comprising:

a body (1) having a lower part with a longitudinal pusher (13) substantially parallel to a base of the body (1) and an upper part of the body (1) having longitudinal holes (23*a*, 23*b*) in side walls of the body (1) near ends of the body (1);

a slider (2) located above the pusher (13) having lateral holes (24*a*, 24*b*) at ends of the slider (2), and the slider (2) having first and second chambers, wherein the first chamber has a closing spring (15) and a closing choke (11) disposed therein, and the second chamber has a closing gripper (6) slidably connected with the closing choke (11) and remaining in contact with the closing spring (15), and one end of the slider (2) in which the closing spring (15) and the closing choke (11) are located is terminated with a hooked attachment (25);

an opening spring (14) attached to an outer side of the body (1), and an opening choke (12) attached on the opposite side of the body (1), whereby one end of the opening spring (14) and of the opening choke (12) are permanently attached to the walls of the body (1) and the other end of the opening spring (14) and the opening choke (12) are connected with a pin (21) placed through the longitudinal holes (23*a*) near one end of the body (1) and holes (24*a*) in the slider (2), and a pin (19) placed through the longitudinal holes (23*b*) near the other end of the body (1) and holes (24*b*) in the slider (2);

a rotary and spring mounted slider gripper (8) at one end of the body (1) remaining in contact with one end of the pusher (13) and provided with a releasable attachment (26) that releasably fits to the hooked attachment (25) at the end of the slider (2); and a permanently fixed housing on the opposite end of the body (1) as the rotary and spring mounted slider gripper (8) in which first and second rollers (10*a*, 10*b*) are arranged in parallel to the base of the body (1), whereby the first roller (10*a*) is movable, and the second roller (10*b*) is stationary, and the movable first roller (10*a*) is located in a support (5), which is spring mounted to the housing, and a side surface of the support (5) remains in contact with an opposite end of the pusher (13).

2. The closing device, according to claim 1, comprising:

the body (1) having the shape of a channel bar, which, in cross section, is narrower in a lower part than in an upper part of the body (1).

* * * * *